US007111524B2

(12) United States Patent
Kiczek et al.

(10) Patent No.: US 7,111,524 B2
(45) Date of Patent: Sep. 26, 2006

(54) CABLE ACTUATED ADJUSTABLE PEDAL

(75) Inventors: Casimir R. Kiczek, Livonia, MI (US); David A. Elgart, Waters, MI (US); Dean Reynolds, Elmira, MI (US); Charles L. Flynn, Davisburg, MI (US)

(73) Assignee: Dura Global Technologies, Inc., Rochester Hills, MI (US)

( * ) Notice: Subject to any disclaimer, the term of this patent is extended or adjusted under 35 U.S.C. 154(b) by 89 days.

(21) Appl. No.: 10/613,890

(22) Filed: Jul. 3, 2003

(65) Prior Publication Data

US 2005/0016319 A1 Jan. 27, 2005

Related U.S. Application Data

(60) Provisional application No. 60/393,772, filed on Jul. 3, 2002.

(51) Int. Cl.
*G05G 1/14* (2006.01)

(52) U.S. Cl. ..... 74/512

(58) Field of Classification Search ..... 74/512, 74/500.5, 501.5 R, 513, 560, 478; 180/334
See application file for complete search history.

(56) References Cited

U.S. PATENT DOCUMENTS 3,282,125 A * 11/1966 Dully ..... 74/560
3,333,902 A * 8/1967 Liverance et al. ..... 303/2
3,643,524 A 2/1972 Herring
3,643,525 A 2/1972 Gibas
3,693,471 A * 9/1972 Glance ..... 74/518
3,861,237 A * 1/1975 Mounts ..... 74/516
3,975,972 A * 8/1976 Muhleck ..... 74/560
4,841,798 A * 6/1989 Porter et al. ..... 74/501.5 R
5,632,183 A 5/1997 Rixon et al.
5,676,220 A * 10/1997 Dapsi et al. ..... 180/334
5,697,260 A 12/1997 Rixon et al.
5,722,302 A 3/1998 Rixon et al.
5,819,593 A 10/1998 Rixon et al.
5,916,330 A * 6/1999 Jacobson ..... 74/512
5,937,707 A 8/1999 Rixon et al.
5,964,125 A 10/1999 Rixon et al.
6,820,895 B1 * 11/2004 Levine ..... 280/735

* cited by examiner

*Primary Examiner*—Vicky A. Johnson
(74) *Attorney, Agent, or Firm*—Dean B. Watson

(57) ABSTRACT

An adjustable pedal includes a first member with a slot and a second member movable along the slot relative to the first member. A pin is disposed in the slot. A biasing member urges the second member toward the one end. A tension control member is connected to the pin to selectively adjust the second member. The tension control member has a secondary lock member. To prevent movement of the second member relative to the first member in one condition and permit movement of the second member relative to the first member in another condition. An actuation system employing a cable is disclosed.

16 Claims, 8 Drawing Sheets

11
17
26
12a
12
110
18
38
23
46
22
72
70
68
20
60
30
87
84
80
63
64
24
25
40
39
36
12b
14
16

CABLE ACTUATED ADJUSTABLE PEDAL

CROSS REFERENCE TO RELATED APPLICATIONS

Provisional Application No. 60/393,772. Filed on Jul. 3, 2003

STATEMENT REGARDING FEDERALLY SPONSORED RESEARCH

Not Applicable

REFERENCE TO MICROFISHE APPENDIX

Not Applicable

FIELD OF INVENTION

The present invention generally relates to an improved control pedal for a motor vehicle and, more particularly, to a control pedal for a motor vehicle that is selectively adjustable to desired positions with a cable.

BACKGROUND AND SUMMARY OF THE INVENTION

Control pedals are typically provided in a motor vehicle, such as an automobile, which are foot operated by the driver. Separate control pedals are provided for operating brakes and an engine throttle. When the motor vehicle has a manual transmission, a third control pedal is provided for operating a transmission clutch. A front seat of the motor vehicle is typically mounted on tracks so that the seat is forwardly and rearwardly adjustable along the tracks to a plurality of positions so that the driver can adjust the front seat to the most advantageous position for working the control pedals.

This adjustment of moving the front seat along the tracks generally fills the need to accommodate drivers of various sizes, but it raises several concerns. First, this adjustment method still may not accommodate all drivers due to very wide differences in anatomical dimensions of drivers. Second, the position of the seat may be uncomfortable for some drivers. Therefore, it is desirable to have an additional or alternate adjustment method for driver control devices to accommodate drivers of various sizes.

Many proposals have been made to selectively adjust the position of the control pedals relative to the steering wheel and the front seat in order to accommodate drivers of various sizes. It would be readily apparent to those skilled in the art that these adjustable control pedals can actuate both conventional cable controls and electronic throttle control (ETC), because the ETC is a function separate from adjustability and the ETC module would typically be positioned remote from the mechanism for adjustment of the control pedals.

U.S. Pat. Nos. 5,632,183; 5,697,260; 5,722,302; 5,819,593; 5,937,707; and 5,964,125, the disclosures of which are expressly incorporated herein in their entirety by reference each disclosure an example of an adjustable control pedal assembly. This control assembly includes a hollow guide tube, a rotatable screw shaft coaxially extending within the guide tube, a nut in threaded engagement with the screw shaft and slidable within the guide tube, and a control pedal rigidly connected to the nut. The control pedal is moved forward and rearward when an electric motor rotates the screw shaft to translate the nut along the screw shaft within the guide tube. While this control pedal assembly may adequately adjust the position of the control pedal to accommodate drivers of various sizes, this control pedal assembly is relatively complex and expensive to produce.

U.S. Pat. Nos. 3,643,525 and 3,643,524, the disclosures of which are expressly incorporated herein in their entirety by reference, each disclose an example of an adjustable control pedal assembly which is much less expensive to produce. Each control pedal assembly includes an upper arm having a single horizontal slot, a rotatable screw shaft attached to the upper arm and extending along the slot, a nut in threaded engagement with the screw shaft and having a pin slidable within the slot, and a control pedal rigidly connected to the nut. Each control pedal is moved forward and rearward when an electric motor rotates the screw shaft to translate the nut along the screw shaft. While these control pedal assemblies may adequately adjust the position of the control pedal to accommodate drivers of various size and they are still complex and relatively expensive to produce.

Accordingly, there is a need in the art for an adjustable control pedal assembly which selectively adjusts the position of the pedal with a simplified actuation system employing a cable to accommodate drivers of various size, is relatively inexpensive to produce, is highly reliable to operate, and prevents pedal adjustment movement in the event of cable failure.

The present invention provides an adjustable control pedal for a motor vehicle, which overcomes at least some of the above-noted problems of the related art. According to one embodiment of the present invention, an adjustable control pedal includes, in combination, a first member having one end, another end, and a slot formed between one end and another end. A pin is disposed in the slot a second member is connected to the pin and is movable along the slot relative to the first member. A biasing member is adjacent the pin and biases the second member toward one end. Additionally, a tension control member is connected to the pin to selectively adjust the second member. The tension control member includes a secondary lock.

In another embodiment of the present invention, an adjustable control device for pedals includes, in combination, first and second control pedals, each control pedal includes a first support member and a second support member adjacent to the first support member. The first member has a first end, a second end and a slot formed between the first end and the second end. A pin is slidably mounted in the slot and is secured to the second support. The second support member is movable along the slot relative to the first support member. A biasing member is between the pin and the first member and biases the second member toward the one end. A tension control member is connected to the first support member to selectively adjust the second member along the slot. The biasing member includes one of a torsion spring, an elastomeric member, and a coil spring.

From the foregoing disclosure and the following more detailed description of various preferred embodiments it will be apparent to those skilled in the art that the present invention provides a significant advance in the technology and art of adjustable control pedal assemblies. Particularly significant in this regard is the potential the invention affords for providing a high quality, feature-rich, low cost assembly. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 1:
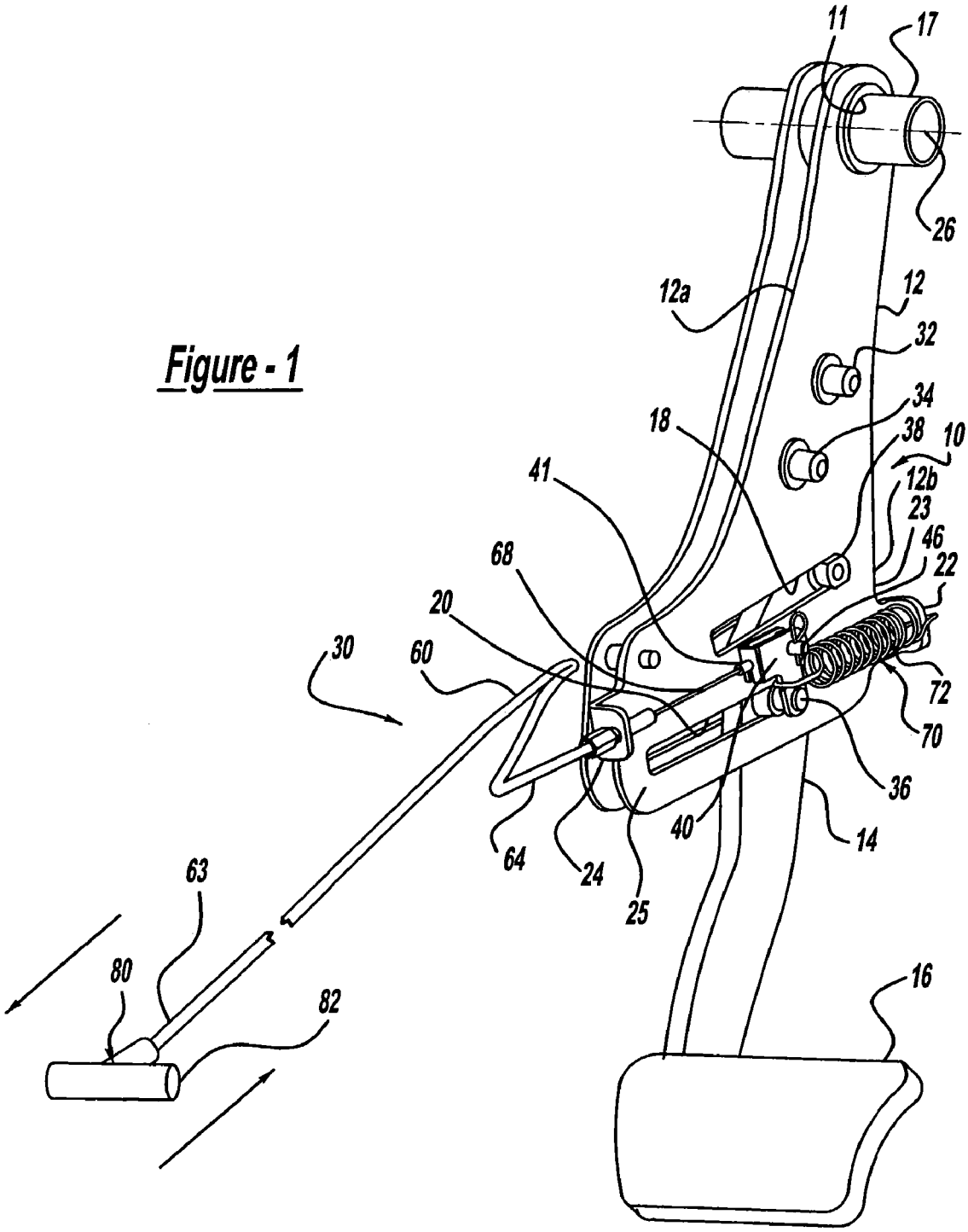
FIG. 1 is a right-rear perspective view of an adjustable control pedal according a first embodiment of the present invention.

It should be understood that the appended drawings are not necessarily to scale, presenting a somewhat simplified representation of various preferred feature illustrative of the basic principles of the invention. The specific design features of an adjustable control pedal as disclosed herein, including, for example, specific dimensions, orientations, and shapes of the pedal arms and the slots will be determined in part by the particular intended application and use environment. Certain features of the illustrated embodiments have been enlarged or distorted relative to others to facilitate visualization and clear understanding. In particular, thin feature may be thickened, for example, for clarity or illustration. All references to direction and position, unless otherwise indicated, refer to the orientation of the control pedal assembly illustrated in the drawings. In general, up or upward refers to an upward direction in the plane of the paper in FIGS. 1 through 5, 7 and 9 and down or downward refers to a downward direction in the plane of the paper in FIGS. 1 through 5, 7 and 9. Also in general, fore or forward refers to a direction toward the front or firewall of the motor vehicle, that is, to the right in the plane of the paper in FIG. 3 and aft or rearward refers to a direction toward the rear of the motor vehicle, that is, to the left in the plane of the paper in FIG. 3.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved adjustable control pedals disclosed herein. The following detailed discussion of various alternative and preferred embodiments will illustrate the general principles of the invention with reference to an adjustable control pedal for use with a motor vehicle. Other embodiment suitable for other applications will be apparent to those skilled in the art given the benefit of this disclosure Referring to the drawings, FIGS. 1 to 4 show an adjustable control pedal 10 for motor vehicle, such as an automobile, according to a first embodiment of the present invention which is selectively adjustable to a desired forward/rearward position by a motor vehicle operator or driver. While the illustrated embodiments of the present invention are particularly adapted for use with an automobile, it is noted that the present invention can be utilized with any vehicle having at least one foot operated control pedal including trucks, buses, vans, recreational vehicles, earth moving equipment and the like, off road vehicles such as dune buggies and the like, personnel carriers, golf carts, air borne vehicles, and water borne vehicles.

Figure 8:
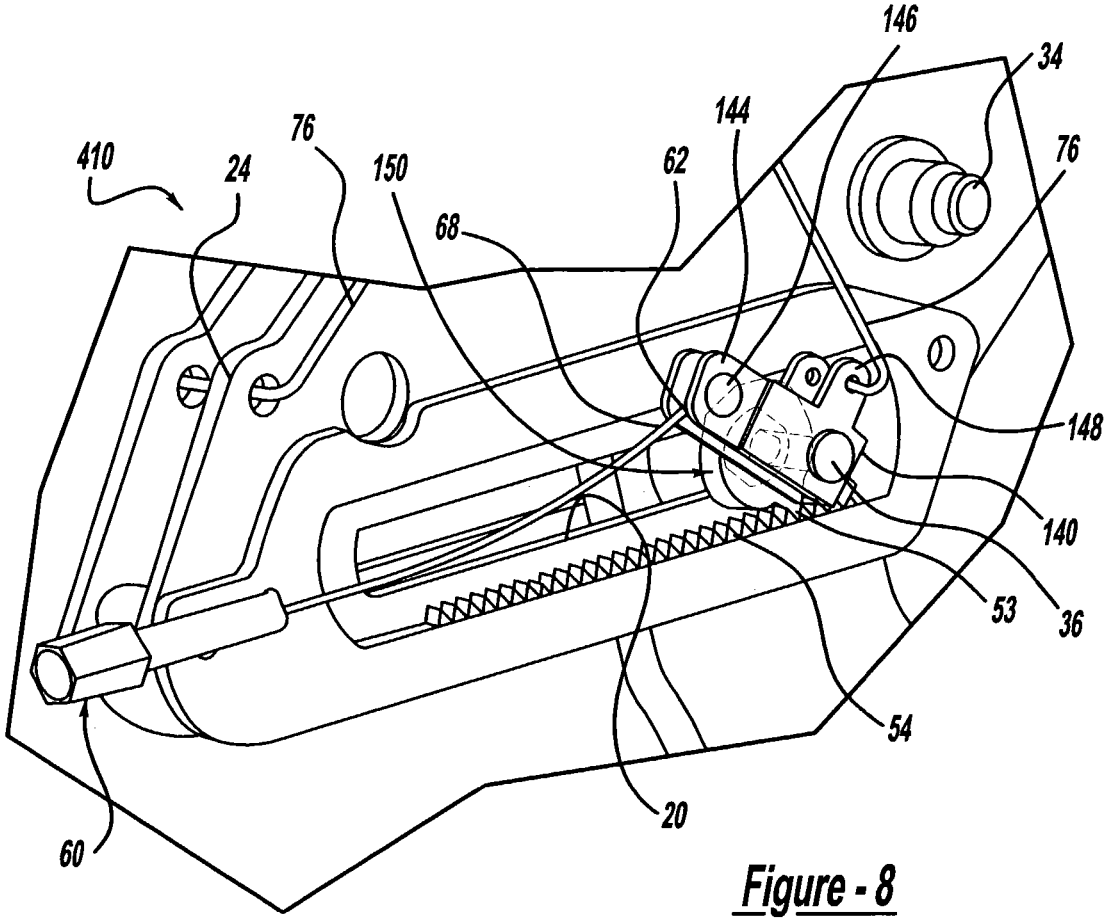
FIG. 8 is a right side partial elevational view of the adjustable control pedal of FIG. 7.
Figure 9:
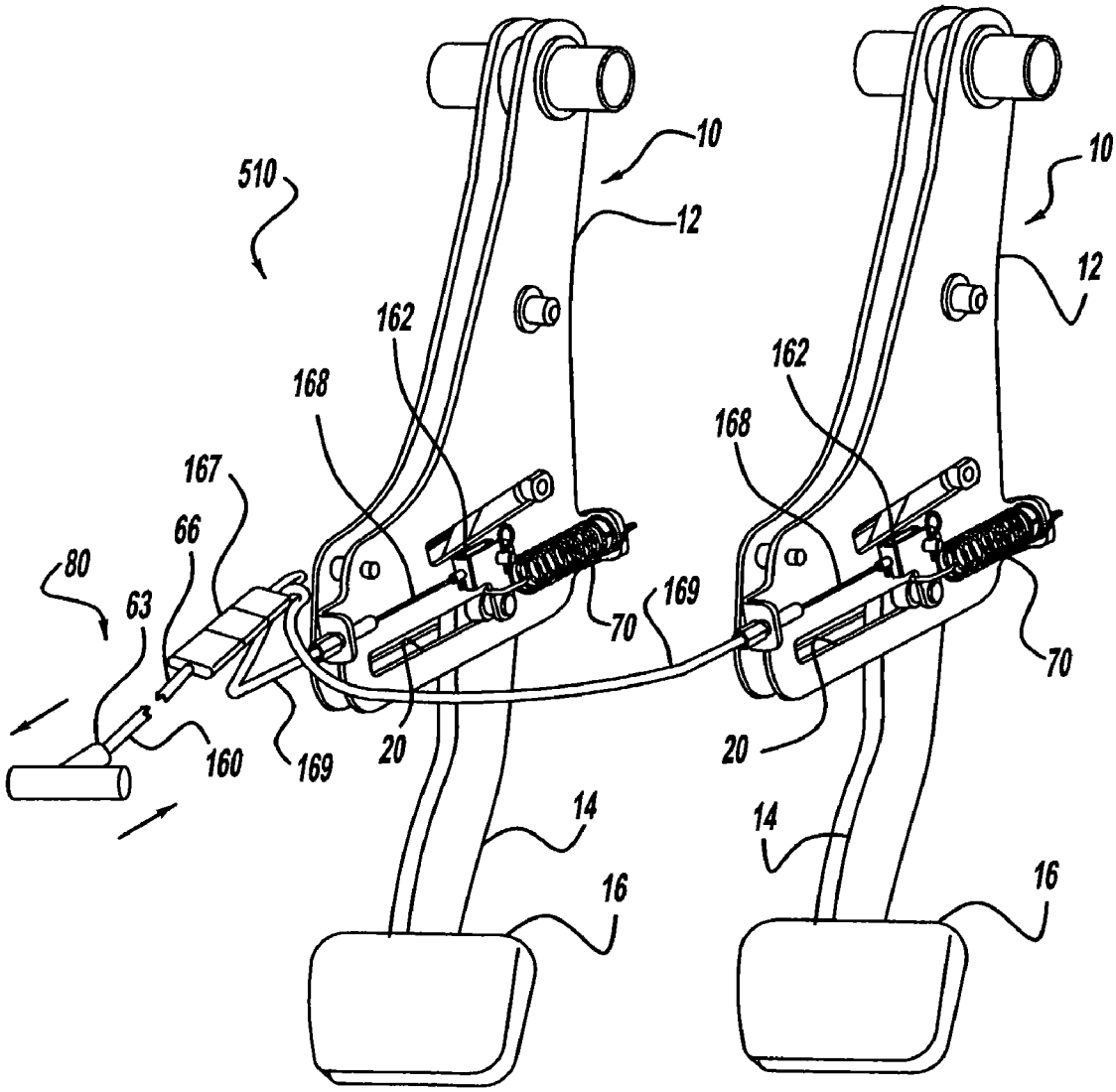
FIG. 9 is a left side elevational view of the sixth embodiment of the adjustable control pedals.

The illustrated adjustable control pedal 10 is adapted as a brake pedal but it is noted that adjustable control pedal 10 can alternatively be adapted as a clutch, accelerator, or other desired pedal within the scope of the present invention. While a single adjustable control pedal 10 is illustrated in FIGS. 1 through 5, 7 and 8 it is also noted that two control pedals 10 can be utilized together within the scope of the present invention such as, for example, control pedals 10 adapted as brake and accelerator pedals respectively as is shown in FIG. 9. It is further noted, more than two control pedals 10 can be utilized together within the scope of the present invention such as, for example, three control pedals 10 adapted as clutch, brake and accelerator pedals respectively. The control pedal 10 is selectively adjustable by the motor vehicle operator in a forward/rearward direction as described in more detail hereinafter. When more than one adjustable control pedal 10 is utilized, the control pedals 10 are preferably adjusted together simultaneously to maintain desired relationships between the control pedals 10 such as, for example, "step over", that is, the forward position of the accelerator pedal relative to the brake pedal, and "pedal angles", that is, the orientation of the contact surfaces of the pedal pads. It is noted however, that individual adjustment of a single control pedal 10 is within the scope of the present invention.

Returning to FIGS. 1 to 4, the control pedal 10 includes an upper pedal arm 12, a lower pedal arm 14 supported by the upper pedal arm 12 and carrying a pad or pedal 16 for engagement by the foot of the motor vehicle operator, a tension control assembly 30 for moving the lower pedal arm 14 relative to the upper pedal arm 12 to adjust the fore and aft position of the pedal 16 and a biasing member 70.

The first or upper pedal arm 12 is sized and shaped for pivotal attachment to a mounting bracket (not shown). The mounting bracket is adapted to rigidly attach the adjustable control pedal 10 to a firewall or other rigid structure of the motor vehicle in a known manner. The illustrated first or upper support member 12 has an opening 11 formed in cooperation with the mounting bracket by means of an axle or pivot pin 17 pressed into opening 11 in a well known manner.

The illustrated upper pedal arm 12 is a generally triangular shaped plate oriented in a vertical and horizontal plane although any suitable shape is within the scope of the invention. The upper pedal arm 12 is preferably formed of a suitable metal such as steel but can alternatively be formed of a suitable plastic such as NYLON. The illustrated upper pedal arm 12 is generally vertically oriented with an upper portion 12*a* which generally extends downward from the opening 11 and a generally horizontal lower portion 12*b* which generally extends in a rearward direction from a lower end of the upper portion 12*a*. The upper portion 12*a* is adapted for pivotal attachment of the lower pedal arm 14 to the mounting bracket (not shown) as described hereinabove. The illustrated opening 11 is located near the top of the upper portion 12*a* but the opening 11 can have other suitable locations on the upper pedal arm 12 within the scope of the present invention.

The lower portion 12*b* is adapted for supporting the lower pedal arm 14 and for selected fore and aft movement of the lower pedal arm 14 along the lower portion 12*b* as described in more detail hereinafter. The illustrated lower portion 12*b* has a pair of vertically spaced apart and parallel slots 18, 20 formed therein which generally extend in a forward/rearward direction along the length of the link lower portion 12*b*. The illustrated slots 18, 20 are each substantially straight and horizontal. Preferably, the drive or lower slot 20 is offset rearward of the guide or upper slot 18 but overlapping the upper slot 18. The lower portion 12*b* is substantially planar or flat in the area of the slots 18, 20 and slots 18, 20 are open laterally through the entire thickness of the upper pedal arm 12. The slots 18, 20 are sized and shaped for cooperation with the lower pedal arm 14 for substantially linear forward/rearward movement of the pedal 16 relative the upper pedal arm 12 over a desired adjustment range, such as, by non limiting example, about three inches, as described in more detail hereinbelow. It is noted that the separate upper and lower slots 18, 20 are elongated apertures, but alternatively can be separate portions of a single slot such as a "C-shaped", "S-shaped", arcuate shaped or other nonlinear slot configuration suitable for practicing the invention.

The upper pedal arm 12 is operatively connected to a control device such as a clutch, brake or throttle such that pivotal movement of the upper pedal arm 12 about the pivot axis 26 formed through opening 11 operates the control device in a desired manner. The control device is well known to those skilled in the art.

The illustrated upper pedal arm 12 is provided with pins 36 and 38. Pin 36 that extends laterally through lower slot 20 and is connected to the tension control assembly 30 by conventional fastening means well known in the art. Pin 38 extends laterally through upper slot 18. The illustrated upper pedal arm is also provided with pin 32 for connection to a control device such as a throttle or brake device by a mechanical actuator and pin 34 for connection to a switch for indicator lights, such as, by way of non limiting example, brake lights.

The lower pedal arm 14 is preferably formed of a suitable metal such as steel but one or both can alternatively be formed of a suitable plastic such as NYLON. The illustrated lower pedal arm 14 is formed of an elongate plate oriented in a vertical plane substantially parallel to plane of the upper pedal arm 12. The upper end of the lower pedal arm 14 is adapted for linear movement relative to upper pedal arm 12 along the slots 18, 20. Guide and drive pins 36, 38 that are laterally and horizontally extending therefrom, cooperate with slots 18, 20 of the upper pedal arm 12 to form sliding pin and slot connections for linearly moving the lower pedal arm 14 relative to the upper pedal arm 12. Optionally, each of the pins 36, 38 respectively, has sleeves 39 that are disposed about the pins (See FIG. 4). Each sleeve 39 slidingly engages their respective slots 18, 20. The lower end of the lower pedal arm 14 is sized and shaped to carry the rearward-facing pedal 16. The pedal 16 is adapted for depression by the driver of the motor vehicle to pivot the control pedal 10 about pivot axis 26 formed in opening 11, to obtain a desired control input to the motor vehicle through the movement of the pin 32.

Figure 2:
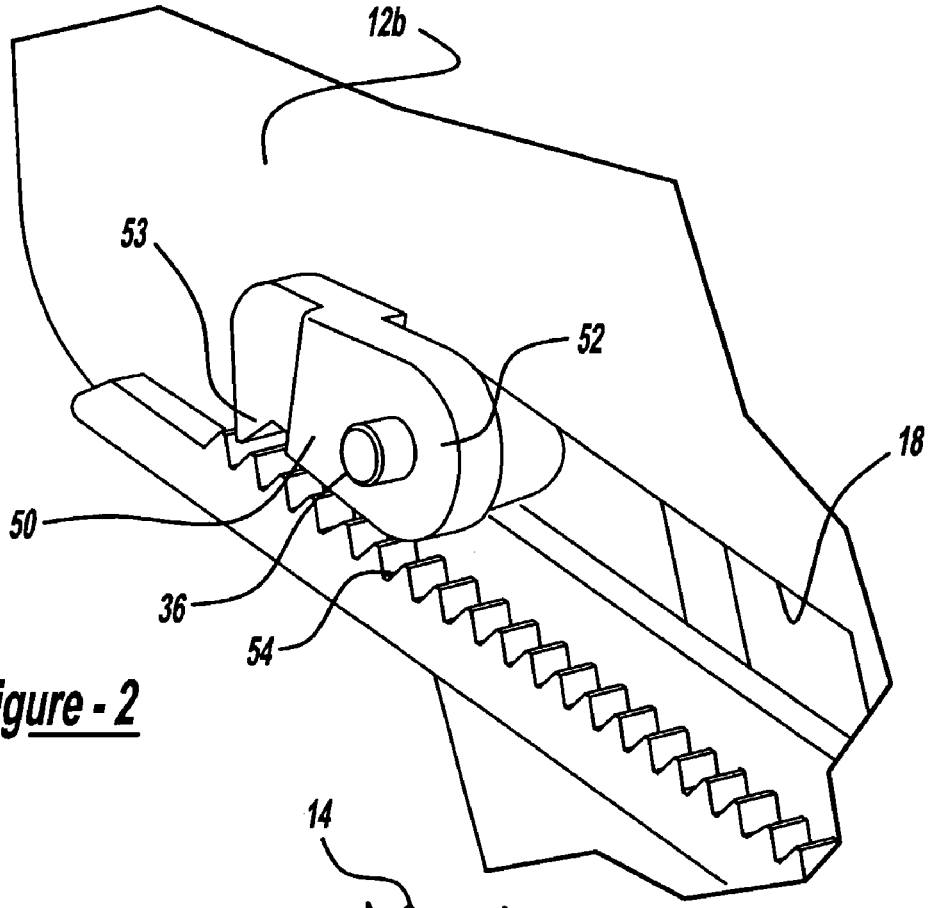
FIG. 2 is a left-rear perspective view of the adjustable control pedal of FIG. 1.
Figure 4:
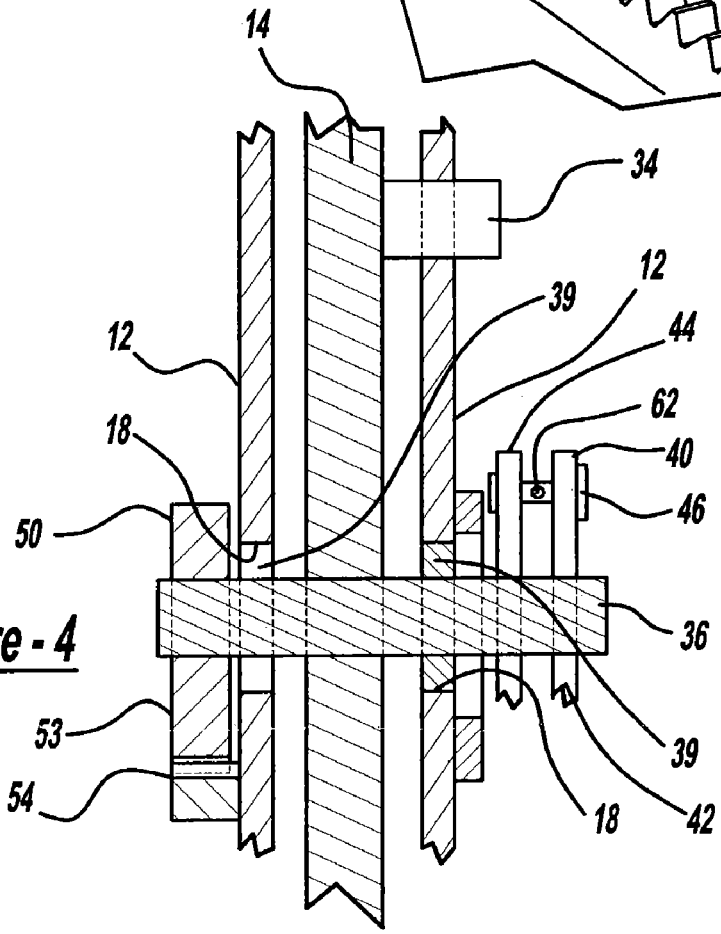
FIG. 4 is a cross-sectional view of the adjustable control pedal of FIGS. 1 to 3.
Figure 3:
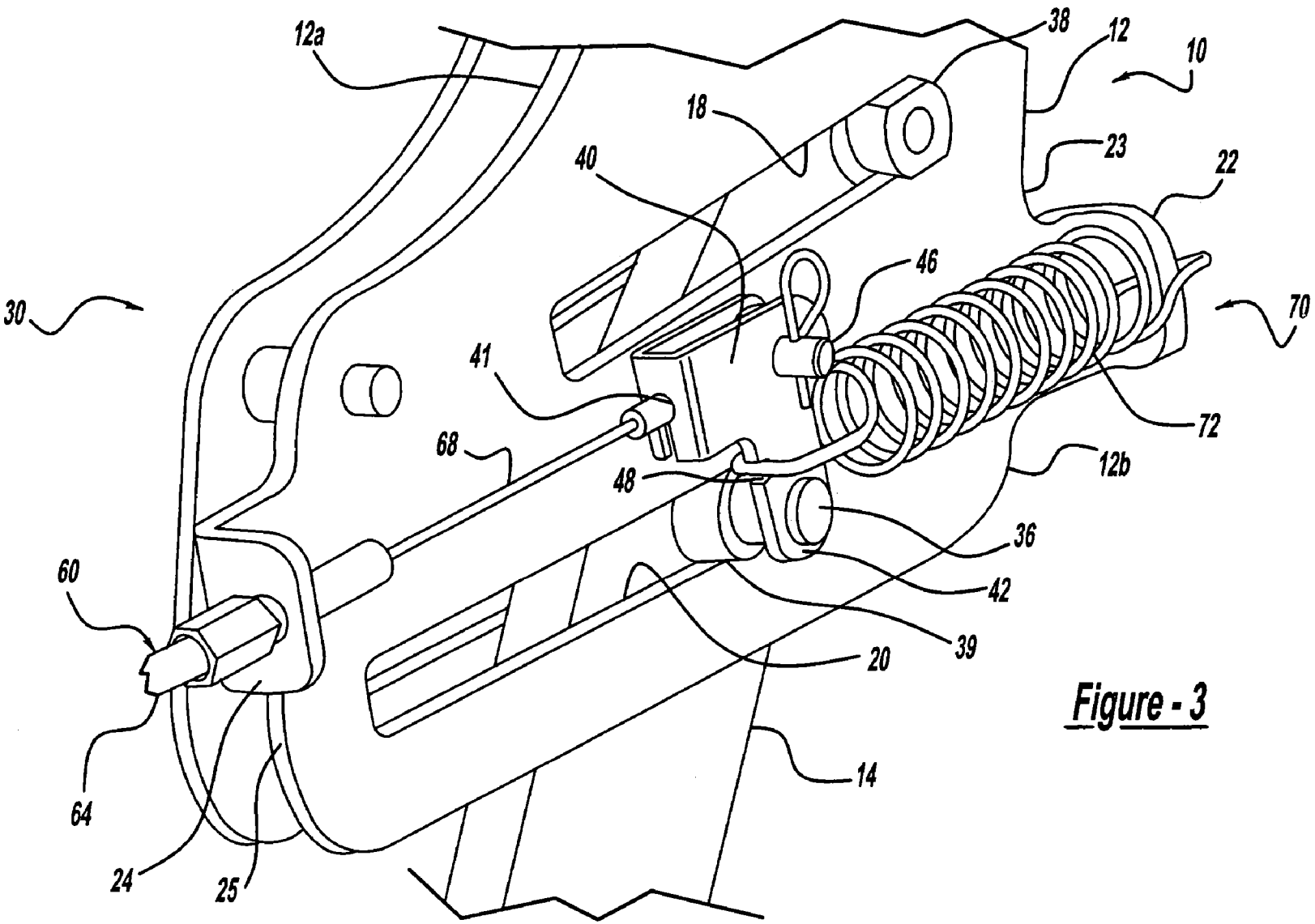
FIG. 3 is a right side partial elevational view of the adjustable control pedal of FIGS. 1 and 2.

Tension control assembly 30 is connected to the upper pedal arm 12. The tension control assembly 30 includes clip 40, locking member 50, cable 60, and actuator 80 for movement of the lower pedal arm 14 relative to the upper pedal arm 12. As best shown in FIGS. 1, 3 and 4, the guide pin 36 has a radially extending clip 40 attached at its one end. The illustrated clip 40 is U shaped with a bottom portion 42 that has an aperture for engaging the guide pin 36. Clip 40 extends away from the aperture to form a lever arm portion 44 that includes a cable engaging pin 46 and a notch 48. Pin 46 extends parallel and spaced away from the guide pin 36. Notch 48 is between pin 46 and the aperture for engaging the guide pin 36. The opposite end of guide pin 36 has a radially extending locking member 50 pivotally connected thereto as shown in FIG. 2.

Locking member 50 is pivotally connected to the other end of guide pin 36 and includes a portion forming pawl section 52 with at least one tooth portion 53 at its end. Locking member 50 also includes a gear sector 54 that is formed on lower portion 12*b* of upper support member. Gear sector 54 is substantially parallel to and adjacent but spaced away from lower slot 20. Sector 54 has a corresponding tooth profile that is designed to engage tooth 53. When the guide pin 36 is rotated in a counter clockwise direction looking toward the pin in GIG. 2, the pawl section rotates tooth 53 until contact is made with sector 54; and when guide pin 36 is rotated clockwise, the tooth 53 disengages the tooth profile of sector 54 to enable the lower pedal 14 to move relative to upper pedal 12.

Returning back to FIGS. 1, 3 and 4, cable 60 is connected to clip 40 to permit moving the lower pedal 16 relative to upper pedal 12. Cable 60 is conventional with a single outer conduit 64 and a single inner core 68. Cable 60 has a first end 62 and a second end 63. First end 62 is conventionally attached to cable engaging pin 46 of clip 40. To assure proper alignment and travel distance of lower pedal relative to upper pedal, the outer sheath or conduit 66 of cable 60 is connected by conventional means to cable support or bracket portion 24 which is located near edge 25 of first pedal support member 12. Flexible inner core or strand 68 extends from cable support 24 toward clip 40 and is inserted through aperture 41 in clip 40. Aperture 41 may optionally be a hole or a slot. The first end 62 of cable 40 is conventionally fastened to cable engaging pin 46 and second end 63 is conventionally connected to actuator 80. The illustrated actuator is a manual handle 82 that is conventionally mounted to the dashboard (not shown) and operates in a known manner.

Biasing member 70 biases the lower pedal toward the forward end of the motor vehicle or firewall (not shown). The illustrated biasing member 70 is a coil spring 72 with one hook end and another hook end. One hook end of a biasing member 70 is attached to the upper arm 12 through an aperture in a cantilevered support member 22. Support member 22 is formed near one edge 23 of first member 12. The location of support member will depend on the distance the lower pedal must travel relative to the upper pedal, the desired biasing force, and the length of the coil spring and other application specific restraints. The other hook end fits into notch 48 in clip 40. Coil spring 72 is preferable made of steel or other suitable metal. Alternatively, the bias member is an elastomeric tension member that is stretched when the guide pin is moved aft or away from edge 23. Elastomer tension member is preferably made of natural or synthetic rubber, as is well known in the art. Bias member 70 is designed to permit travel of pins 36, 38 in slots 18, 20 so that lower pedal can provide an operator an adjustment range of the lower pedal 14, for example, of approximately 3 inches. The travel range is not limited to three inches but may extend a greater or lesser distance depending on the travel design requirements of each specific application. Those skilled in the arts will recognize that forward and rearward travel of the lower pedal 16 is determined by the length of slots 18, 20.

In operation, with pedal 16 in the full forward position, the operator pulls handle 82 away from the dashboard or aft toward the operator. This action develops a tension force in the strand 68 and movement to cause clip 40 to overcome the bias of biasing member 70 toward the firewall and rotate clip about pin 36 to permit disengagement of tooth 53 of pawl section 52 from gear sector 54. As the tooth disengages from the fear sector, the tension force causes movement of pin 36 in lower slot 20 toward the operator or aft. So long as the operator provides more pull or tension force on the cable through the actuator than is required to overcome to the bias of bias member so as to pivot the clip about pin 36 and thereby cause tooth 53 to disengage from gear sector 54, the operator can continue to pull or provide more tension force to move lower pedal aft toward the operator. To fix the position of the pedal, the operator quickly releases the force on the handle and in the absence of tension in cable 60, the biasing member pivots the clip so that the tooth engages the gear sector to lock the position of the pedal 16 relative to the upper pedal 12. When it is desired to move the lower pedal forward, that is toward the front or firewall, the operator provides slightly less tension force to overcome the bias of the bias member, to pivot the clip about pin 36 and to cause tooth to disengage from gear sector, then the operator carefully controls the tension force in the cable to keep the tooth disengaged from the gear and permit the handle to move forward and allows the bias of the biasing member to move the pedal forward or toward the firewall. Again, to fix the position of the lower pedal relative to the upper pedal with locking member 50, the operator quickly releases the tension force in the cable through the actuator. This causes biasing member to rotate the clip so that the tooth engages the gear sector to lock the position of the pedal 16 relative to the upper pedal 12. In both of the above modes of operation, when the cable breaks the lower pedal is locked in place to the upper pedal because the pawl engages the gear sector in the absence of tension force on the cable and due to the biasing force of bias member 70 as discussed above.

Figure 5:
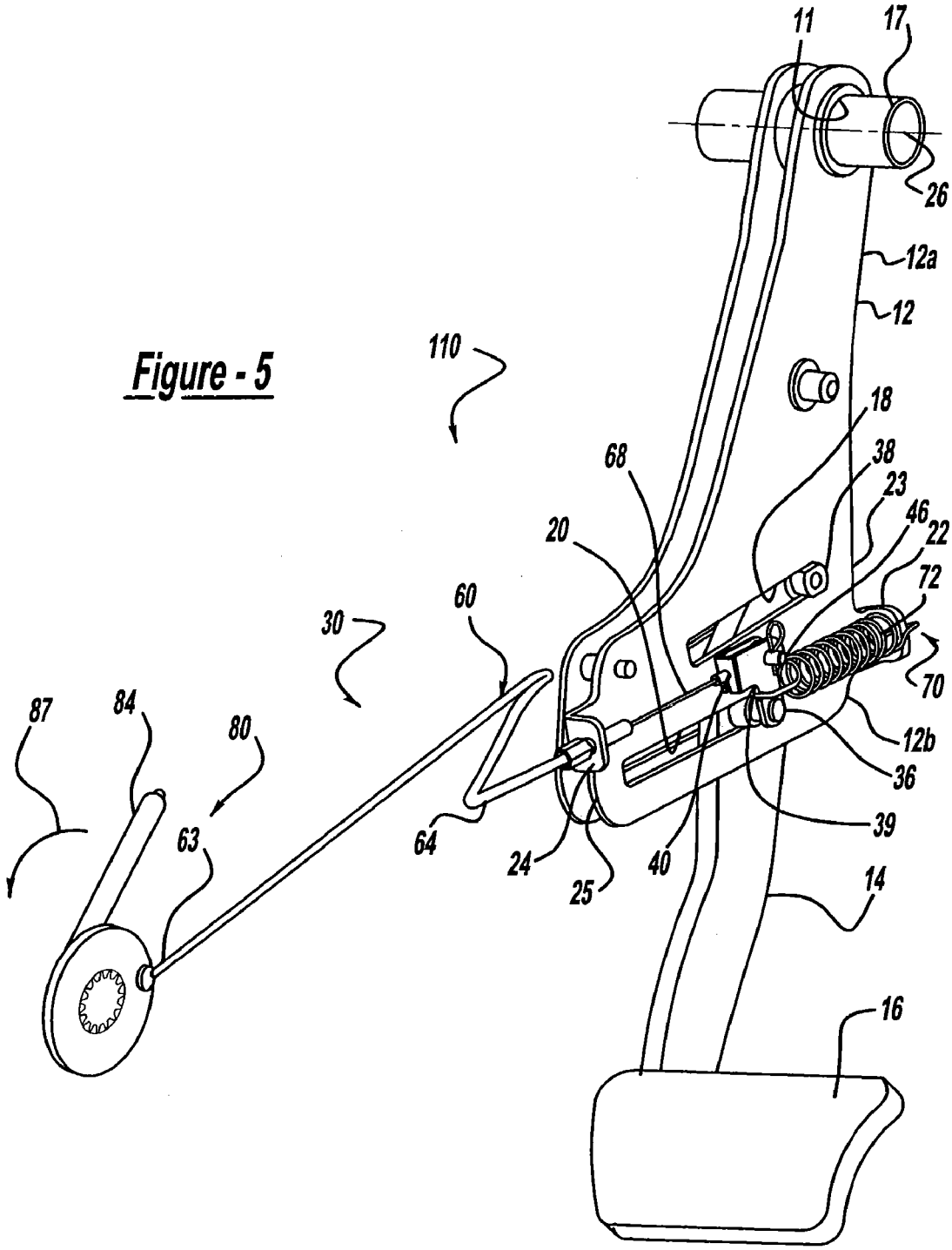
FIG. 5 is a left side elevational view of a second embodiment of the adjustable control pedals.

FIG. 5 illustrates an adjustable control pedal 110 for a motor vehicle according to a second embodiment of the present invention. In the second embodiment and all the other embodiments, like reference numbers of the first embodiment are used for like structure. The illustrated control pedal 110 is the same as the first embodiment except that actuator 80 is a manually operated hand lever 84 such as described in U.S. Pat. Nos. 5,001,942; 5,303,610; 5,448,928; 5,509,326; and 5,528,957, the disclosures of which are incorporated by their entirety herein by reference. The cable lock device of the manually operated lever 84 provides the primary lock for the pedal adjustment and the locking member 50 functions as a secondary lock and prevents movement of the pedal in the event of cable failure. The second end 63 of cable 60 is connected to lever 84 in a known manner. Thus, when the operator desires to move the pedal away from the firewall or aft (with pedal 16 in the full forward position), the operator rotatably moves the handle of lever 84 in direction 87 relative to the floor (not shown) or console (not shown) or from the dashboard (not shown) depending on the application configuration, in a known manner. The lever movement causes strand 68 to move and causes pivot clip 40 to rotate and overcome the bias force of biasing member and permit adjustment of the pedal as was described earlier in the first embodiment. When it is desired to move the lower pedal forward, that is toward the front or firewall, the operator rotates the lever relative to the floor but provides slightly less tension force on the cable than when moving the pedal aft but with still enough force ton the lever to overcome the bias of the bias member. This causes the clip to pivot about pin 36 and cause tooth to disengage from gear sector. Then, while still maintaining this level of tension in the cable, the operator permits the lever to rotate in a direction opposite to direction 87 and allows the pedal to move forward or due to the bias of the biasing member (to move the pedal forward or toward the firewall). Again, to fix the position of the lower pedal relative to the upper pedal, the operator quickly releases the tension force on the lever. This causes biasing member to rotate the clip about pin 36 so that the tooth engages the gear sector to lock the position of the pedal 16 relative to the upper pedal 12. In both of the above modes of operation, when the cable breaks; the lower pedal is locked in place to the upper pedal because the pawl engages the gear sector in the absence of tension force form the cable as discussed above. In all other aspects, this embodiment operates the same as the first embodiment.

Figure 6A:
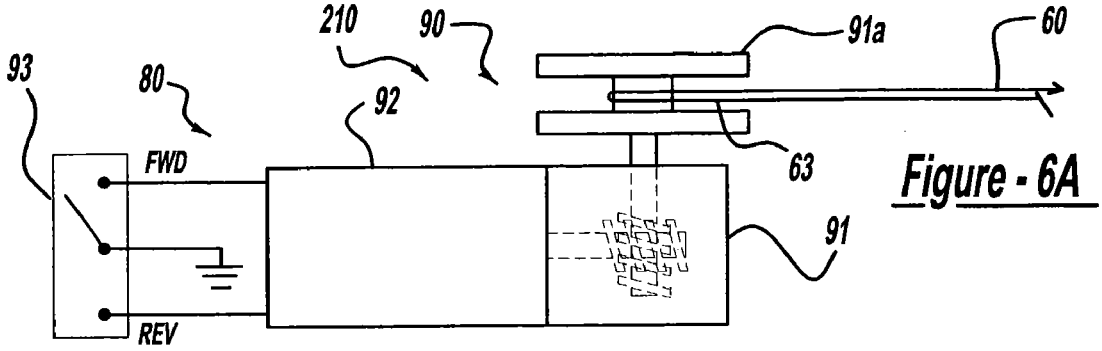
FIG. 6A is a schematic representation of third embodiment of a motor driven cable adjuster for an adjustable control pedal.
Figure 6B:
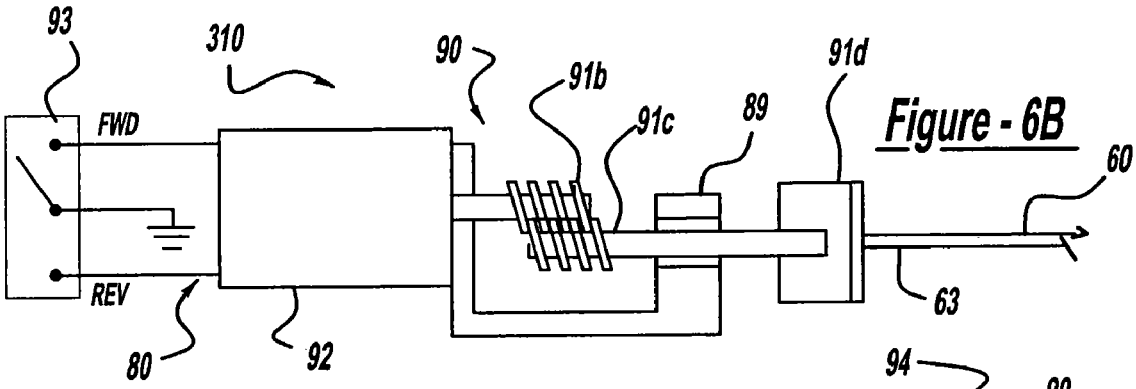
FIG. 6B is a schematic representation of fourth embodiment of a motor driven cable adjuster for an adjustable cable.
Figure 6C:
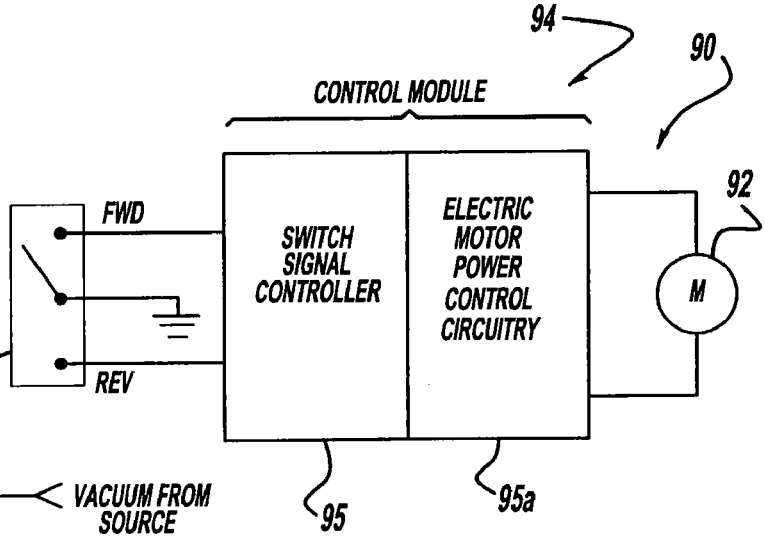
FIG. 6C is a schematic representation of a control module for a motor driven adjuster for an adjustable pedal.
Figure 6D:
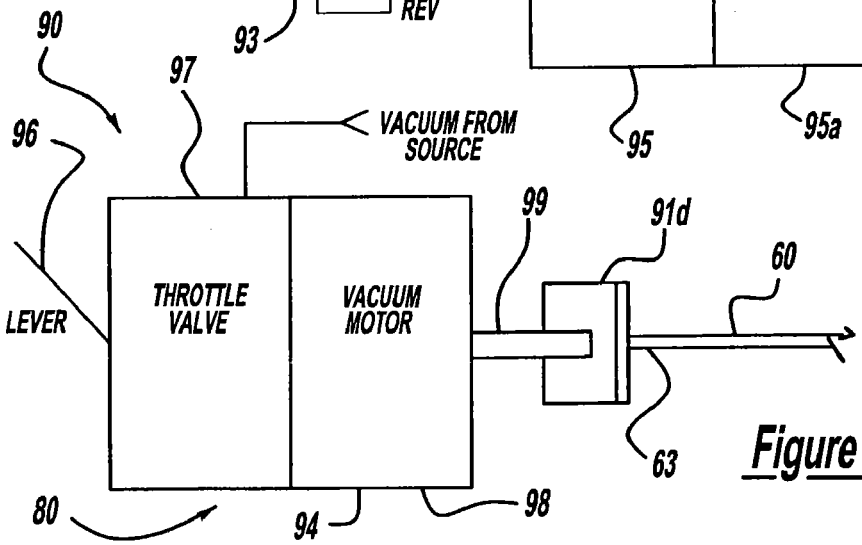
FIG. 6D is a schematic representation of an actuator for a motor driven adjuster for an adjustable pedal.

The third embodiment of the present invention is similar to the first embodiment except that control pedal 210 has an actuator 80 that includes a motor driven device 90 with gear box 91 and pulley 91*a* as shown in FIG. 6A. The fourth embodiment of the present invention is similar to the third embodiment except that the control pedal 310 has an actuator 80 that includes a motor driven device 90 with gear 91*b* and lead screw 91*c* as shown in FIG. 6B. Thus, instead of a handle 82 or lever 84 to manually actuate the tension control assembly, as described in the first and second embodiments, cable 60 is connected to motor driven device 90. Motor driven device 90 may be driven by an electric motor 92 or alternately by a vacuum motor 94, both of which are well known in the art, as shown in FIG. 6D.

The motor device 90 illustrated in FIG. 6A includes electric motor 92 which has a shaft that rotates and is connected to gear box 91 and pulley 91*a* in a known manner. The second end 63 of cable 60 is attached to pulley 91*a* as in conventional. When switch 93 is actuated by the operator, motor 92 rotates causing gear means 91 to rotate, which in turn causes the pulley to rotate. As pulley 91*a* rotates, cable 60 wraps around or unwraps around the pulley depending on the direction of rotation of motor 92.

As illustrated in FIG. 6B, electric motor 92 has a shaft with a worm gear 91*b*. Worm gear 91*b* rotatably engages second worm gear 91*c*. Second worm gear 91*c* is connected to a clevis 91*d*. The second end 63 of cable 60 is conventionally connected to clevis 91*d*. Gear 91*c* is conventionally mounted, for example to a bracket 89 that is mounted to the motor 92 and has an extension to support the shaft of the gear, so that gear 91*c* does not rotate but travels linearly so as to move clevis 91*d*. When switch 93 is actuated by the operator, motor 92 rotates causing second worm gear 91*c* to move the clevis 91*d* linearly in a fore and aft direction and apply or relieve tension on cable 60.

To control the motor device 90 and rotation of the motor 92 in the third and fourth embodiments of the invention, the operator manually actuates electric switch 93. Operating switch 93 causes an electrical signal to be generated that is processed by control module 94 as shown in FIG. 6C. Control module 94 includes switch signal conditioner 95 and electric motor power control circuitry 95*a*. Conditioner 95 processes the signal before the signal passes through the motor power control circuitry 95*a* to actuate motor 92.

When switch 93 is actuated by the operator to move pedal 16 toward the operator (that is in the aft position), signal conditioner permits the normal current to flow into the power control circuitry 95*a* to cause the motor to rotate and operate in a normal manner so as to create sufficient tension or pull on cable 60 to move the pedal as discussed earlier in the first embodiment. To move pedal 16 toward the firewall (forward condition), the switch 93 is actuated by the operator to the reverse position. The signal is processed by the power control circuitry 95*a* to reverse the rotation direction of motor 92 and permits the normal current to flow into power control circuitry 95*a*. In the power control circuitry 95*a*, the current is reduced to control the torque generated by motor 92, for example, by resisters, in a known manner. This in turn reduces the tension on cable 60 to a sufficient level so as to operate the pedal as described earlier in the first embodiment. The motor 92 provides the primary cable position lock capability to prevent the movement of the pedal unless the motor is activated. In the event of cable failure, the locking member functions as a secondary lock to prevent movement of the lower pedal relative to the upper pedal as discussed in the first embodiment. In all other aspects, control pedals 210, 310 operate as in the first embodiment.

Alternatively, the actuator 80 is a vacuum motor 98 as shown in FIG. 6D. Vacuum motors are well known in the prior art, for example as shown in U.S. Pat. Nos. 3,809,125; 4,669,361; 5,934,642; and 6,324,845, the disclosures of which are incorporated herein by reverence by their entirety. The vacuum motor 98 includes a lever 96, throttle valve 97, and plunger 99. When the lever is actuated in one direction by the operator, such as for example, to move the pedals to an aft position, vacuum from a source such as a pump or engine intake passage, actuates the vacuum motor to pull plunger 99, clevis 91*d* and second end 63 of cable 60 toward the motor 98 (thereby putting tension on cable 60) in order to adjust the position of the pedal. If the operator desires to move the pedal in the forward position, the lever is actuated in the opposite or other direction by the operator and vacuum from the source is controlled so that the linear pull from the motor 98 is reduced to a sufficient level (such as by bleeding ambient air into the motor) to control the tension in the cable to the level required to permit forward movement of the pedal as discussed earlier in the first embodiment.

Figure 7:
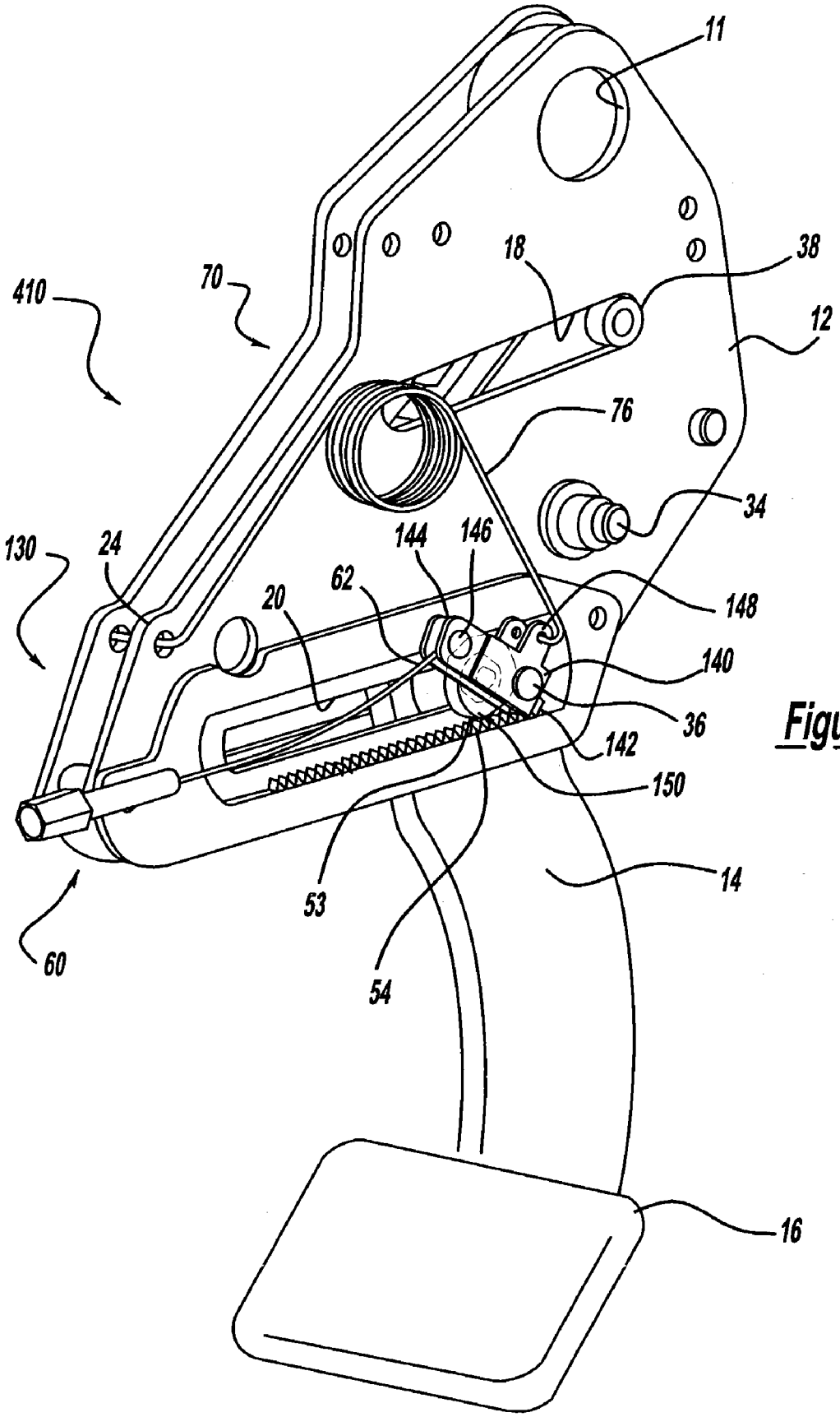
FIG. 7 is a left-rear perspective view cross-sectional view of an adjustable control pedal according to a fifth embodiment of the present invention.

In the fifth embodiment of the present invention, the control pedal is designated by the numeral 410 as shown in FIG. 7 and is similar to the first embodiment. Control pedal 410 includes upper pedal 12, lower pedal 14, cable 60, biasing member 70, and tension control assembly 130.

Tension control 130 includes an actuator clip 140 and locking member 150. Guide pin 36 extends laterally through slot 20 and one end of guide pin 36 has a radially extending clip 140 attached to it. The illustrated clip 140 is U shaped with a bottom portion 142 that has an aperture for engaging the guide pin 36. Clip 140 extends radially away from the aperture to form a lever arm portion 144 that includes an aperture for cable engaging fastener 146. Fastener 146 is conventional and extends parallel to and spaced away from the guide pin 36 and connects cable 60 at its first end 62 to clip 140. Clip 140 includes a second radially extending U-shaped arm portion 148 which is angularly oriented relative to lever arm portion 144 and attached near guide pin 36 at its one end.

The illustrated biasing member is a torsion spring 76 that has one end, another end and a coil portion. One end of torsion spring 76 is fastened to the upper pedal in an aperture near edge 24 and another end is fastened to an aperture near the free end of lever arm portion 148 in a known manner. Thus, with pedal 14 the in the forward condition, the torsion spring biases the free end of the lever portion 148 to rotate clockwise as viewed in FIG. 7. Preferably, the torsion spring is made of steel or from any other suitable material.

Locking member 150 is connected to guide pin 36 and disposed between clip 140 and the pedal arm 12. Locking member 150 includes pawl section 52, tooth 53 and gear sector 54 attached to pedal 12 as best shown in FIG. 8. Tooth 53 engages the adjacent gear sector 54 formed in the upper pedal near slot 20. Cable 60 is connected at its first end 62 to lever arm portion 144 by means of a cable engaging fastener 146 which is inserted into an aperture in the lever arm portion 144 in well known manner. The second end 63 of cable 60 is connected to actuator 80. When the pedal 16 is in the full forward position relative to the upper pedal, coil portion of torsion spring 76 provides a biasing force to urge guide pin 36 and pedal 14 forward (toward the firewall). As the pedal 16 is adjusted by the operator toward the aft position, the coil portion is further compressed, in a known manner, as the actuator 80 and strand 68 are moved aft as described earlier in the first embodiment. As the operator continues to actuate the actuator, the cable develops a tension force to overcome the bias of spring 76 and permits the clip 140 to rotate counterclockwise, as viewed in FIG. 7, about pin 36. When the pin rotates sufficiently, the tooth 53 disengages gear sector 54 and further actuation of the actuator 80 by the operator causes the cable 60 to move guide pin 36 in slot 20 and peal 14 relative to pedal 12. This increases the bias force of the spring 76 to urge pedal 14 toward the firewall or forward position. When the operator seeks to move pedal 14 forward (toward the firewall), the actuator 80 is operated as described previously and in all other aspects, control pedal 410 operates as in the first embodiment, second embodiment, third embodiment or fourth embodiment depending on the actuator employed in practicing the invention.

FIG. 9 shows the sixth embodiment of the present invention, designated by the numeral 510. Control pedal 510 has a pair of similar control pedals 10 except that both are actuated by cable 160. Cable 160 is similar to cable 60 except that cable 160 has a single outer conduit 66, a splitter 167 and a pair of intermediate outer conduits 169 extending from splitter 167 in a known manner. Each intermediate outer conduit has an inner core 168 with a first end 162. Each first end is connected to a corresponding clip on each pedal 10. Cable 160 has a second end 63 connected to actuator 80 so that both pedals may be adjusted together simultaneously as discussed further in U.S. Pat. No. 6,352,077, the disclosure of which is incorporated herein by its entirety. As stated earlier, each of the control pedals 10 can be optionally adjusted individually.

It should be appreciated that each of the features of the various embodiments can be utilized separately or in combination with each of the features of the other embodiments. For example, the fifth embodiment can incorporate an actuator that may be a handle 82, or a pedal lever 86, or an electric motor 92, or a vacuum motor 98. Similarly the biasing member for any of the foregoing embodiments may be a coil spring 72, elastomeric tension member 74 or torsion spring 76 with its corresponding mating components as described earlier.

From the foregoing disclosure and detailed description of certain preferred embodiments, it will be apparent that various modifications, additions and other alternative embodiments are possible without departing from the true scope and spirit of the present invention. For example, it will be apparent to those skilled in the art, given the benefit of the present disclosure, that the shape of the slots can have many different forms. The embodiments discussed were closed and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

The invention claimed is:

1. An adjustable pedal assembly for a motor vehicle comprising in combination:

a mounting bracket;

an upper pedal arm pivotally connected to the mounting bracket;

a lower pedal arm, the lower pedal arm being adjustable in position with respect to the upper pedal arm;

a locking member for preventing adjustment in position of the lower pedal arm with respect to the upper pedal arm;

a stand connected to the lower pedal arm for moving the lower pedal arm aft in a vehicle; and a biasing member for biasing the lower pedal arm toward the forward end of a vehicle.

2. The pedal assembly according to claim 1 wherein the locking member includes a gear and pawl to prevent movement of the lower pedal arm separate from the upper pedal arm in one condition and to permit movement of the lower pedal arm separate from the upper pedal arm in the another condition.

3. The pedal assembly of claim 1 further comprising a slot and pin arrangement for the lower pedal arm to move relative to the upper pedal arm in a substantially linear forward and rearward movement.

4. The pedal assembly according to claim 1 wherein the biasing member comprises a torsion spring, a coil spring or an elastomeric member.

5. The pedal assembly according to claim 1 wherein the strand is a cable, the cable is attached to an actuator.

6. An adjustable control pedal assembly for a vehicle comprising in combination:

a control pedal member the control pedal member including a first pedal arm and a second pedal arm, the first pedal arm being movable in relation to the second pedal arm and a biasing member for biasing one of the pedal arms forward in a vehicle;

a tensioning assembly including a cable connected to a lock member which prevents movement of the second pedal arm relative to the first pedal arm in one tensioning condition, causes movement of the second pedal arm relative to the first pedal arm in a forward direction of a vehicle in another tensioning condition, and to causes movement of the second pedal arm aft in a third tensioning condition.

7. A control pedal assembly according to claim 6 further comprising a slot pin arrangement for supporting sliding of the first pedal arm in relation to the second pedal arm wherein the slot in one of elongated aperture, arcuate, "S" shaped, "C" Shaped and non-linear.

8. A control pedal assembly according to claim 7 where the lock member is mounted on the pin.

9. A control pedal assembly according to claim 7 wherein the lock member includes a rotatable pawl.

10. A control pedal assembly according to claim 6 wherein the lock member includes a gear sector and pawl.

11. A control pedal assembly according to claim 6 further comprising: a manual actuator member connected to the cable.

12. A control pedal assembly according to claim 6 further comprising: a motor driven actuator connected to the cable.

13. An adjustable pedal assembly for a motor vehicle comprising in combination:

a mounting bracket;

an upper pedal arm pivotally attached to the mounting bracket;

a lower pedal arm connected to the upper pedal arm and moveable with respect to the upper pedal arm;

a biasing member for biasing the lower pedal arm forward in a vehicle;

a lock member for preventing movement of the lower pedal arm with respect to the upper pedal arm;

a cable connected to the lock member such that tension by the cable causes the lock member to release the lower pedal aim and the amount of tensioning by the cable is determinative of the positioning of the lower pedal arm with respect to the upper pedal arm aft in a vehicle and the amount of tensioning and the biasing is determinative of positioning the lower pedal arm forward in a vehicle.

14. The adjustable pedal assembly of claim 13, wherein the upper pedal arm has a slot; the lower pedal arm is connected to a pin which is movably disposed in the slot for support and substantially linear movement of the lower pedal arm with respect to the upper pedal arm.

15. The adjustable pedal assembly of claim 14, wherein the lock member includes a gear and pawl, the pawl being connected to the cable and the gear being connected to the upper pedal arm.

16. The adjustable pedal assembly of claim 15, wherein the pawl is biased to engage the gear and its rotatable to a disengaged position upon tensioning of the cable.

* * * * *